US008238792B2

(12) United States Patent
Kim et al.

(10) Patent No.: US 8,238,792 B2
(45) Date of Patent: Aug. 7, 2012

(54) CHARGE ELIMINATOR AND IMAGE FORMING APPARATUS HAVING THE SAME

(75) Inventors: Kyung Rok Kim, Seongnam-Si (KR); Hun Sup Kim, Ansan-Si (KR); Ki Ju Pak, Yongin-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 266 days.

(21) Appl. No.: 12/638,073

(22) Filed: Dec. 15, 2009

(65) Prior Publication Data

US 2010/0158570 A1 Jun. 24, 2010

(30) Foreign Application Priority Data

Dec. 24, 2008 (KR) ..... 10-2008-0133915

(51) Int. Cl.
*G03G 21/00* (2006.01)

(52) U.S. Cl. ..... 399/128

(58) Field of Classification Search ..... 399/38, 399/46, 48, 107, 111, 116–118, 127–129, 399/186

See application file for complete search history.

(56) References Cited

U.S. PATENT DOCUMENTS 5,722,003 A * 2/1998 Suzuki et al. ..... 399/39
2007/0172752 A1* 7/2007 Niimi ..... 430/123.43

FOREIGN PATENT DOCUMENTS

JP 2004-109567 4/2004

OTHER PUBLICATIONS

English language abstract of JP 2004-109567, published Apr. 8, 2004.
Machine English language translation of JP 2004-109567, published Apr. 8, 2004.

* cited by examiner

*Primary Examiner* — Hoan Tran
(74) *Attorney, Agent, or Firm* — Staas & Halsey LLP

(57) ABSTRACT

Disclosed are a charge eliminator and an image forming apparatus having the same. The charge eliminator includes a light source array and a light guide member. The light source array includes a plurality of point light sources. The light guide member includes an incidence face through which light generated from the point light sources is introduced. The light guide member guides the light introduced through the incidence face to the photoconductor. A diffusion pattern is provided at the incidence face of the light guide member to diffuse the light introduced through the incidence face.

20 Claims, 6 Drawing Sheets

CHARGE ELIMINATOR AND IMAGE FORMING APPARATUS HAVING THE SAME

CROSS-REFERENCE TO RELATED APPLICATION

This application claims the benefit of Korean Patent Application No. 2008-0133915, filed on Dec. 24, 2008 in the Korean Intellectual Property Office, the disclosure of which is incorporated herein by reference in its entirety.

TECHNICAL FIELD

Various aspects of the present disclosure relate generally to a charge eliminator employed in an image forming apparatus, and more particularly to, a charge eliminator for irradiating charge elimination light evenly across a photoconductor and an image forming apparatus having the same.

BACKGROUND OF RELATED ART

Image forming apparatuses are devised to form an image on a printing medium based on input signals. Examples of image forming apparatuses may include, printers, copiers, facsimiles, and so-called multi-functional devices that combine some of the functionalities of the aforementioned devices.

In an electro-photographic image forming apparatus, which is one broad type of image forming apparatus, light is irradiated to a photoconductor that had been charged to a uniform electrical potential so as to form an electrostatic latent image on the basis of potential differences on the surface of the photoconductor. The electrostatic latent image is developed into a visible image by application of developer thereto from a developer feed device. The visible image so created is then transferred from the surface of the photoconductor to a printing medium either directly or in some instances indirectly through an intermediate transfer device. The image transferred to the printing medium is fixed to the printing medium via a fusing process. Prior to uniformly charging the photoconductor again to start the process of formation of the subsequent image, a charge eliminator may typically be used to remove the residual electrical potential remaining after the preceding image forming operations.

A general charge eliminator may include a light source, which may be provided as an array of a plurality of point light sources, and a light guide member to guide light generated from the light source to the photoconductor. However, in order to realize a sufficient uniformity in the light across the irradiated portion of the photoconductor, conventional charge eliminators could require a large number of point light sources.

SUMMARY OF DISCLOSURE

In accordance with one aspect of the present disclosure, a charge eliminator to eliminate a residual electric potential on a surface of a photoconductor includes a light source array including a plurality of point light sources, a light guide member including an incidence face through which light generated from the point light sources is introduced, the light guide member serving to guide the light introduced through the incidence face to the photoconductor, and a diffusion pattern provided at the incidence face of the light guide member and serving to diffuse the light introduced through the incidence face.

The diffusion pattern may include at least one recess.

The diffusion pattern may include a plurality of recesses, and the plurality of recesses may define a waveform in a longitudinal direction of the light guide member.

The diffusion pattern may include a plurality of recesses, and a radius of curvature of the plurality of recesses may increase toward opposite sides of a recess corresponding to each of the point light sources.

The charge eliminator may further include a fixing portion provided at the light guide member, and an interval between the point light sources of the light source array may become narrow closer to the fixing portion.

The fixing portion may take the form of a hook protruding from the light guide member.

The point light sources may be Light Emitting Diodes (LEDs).

In accordance with another aspect of the present disclosure, an image forming apparatus includes a photoconductor, a charger to charge the photoconductor with a predetermined electric potential, a light scanning unit to irradiate light, corresponding to image information, to the photoconductor charged with the predetermined electric potential, so as to form an electrostatic latent image, a developer feeder to feed developer to the photoconductor, on which the electrostatic latent image is formed, so as to form a visible image, a transfer unit to transfer the visible image formed on the photoconductor to a printing medium, and a charge eliminator to eliminate a residual electric potential remaining on a surface of the photoconductor, the charge eliminator including a light source array having a plurality of point light sources, a light guide member including an incidence face through which light generated from the point light sources is introduced, the light guide member serving to guide the light introduced through the incidence face to the photoconductor, and a diffusion pattern provided at the incidence face of the light guide member and serving to diffuse the light introduced through the incidence face.

The diffusion pattern may include at least one recess.

The diffusion pattern may include a plurality of recesses, and the plurality of recesses may define a waveform in a longitudinal direction of the light guide member.

The diffusion pattern may include a plurality of recesses, and a radius of curvature of the plurality of recesses may increase toward opposite sides of a recess corresponding to each of the point light sources.

The image forming apparatus may further include a photoconductor housing to rotatably support the photoconductor, and the charge eliminator may include a fixing portion provided at the light guide member and serving to fix the light guide member to the photoconductor housing, and an interval between the point light sources of the light source array may become narrow closer to the fixing portion.

The fixing portion may take the form of a hook protruding from the light guide member.

In accordance with yet another aspect of the present disclosure, a light guide member, provided in a charge eliminator to eliminate a residual electric potential of a photoconductor provided in an image forming apparatus and serving to guide light generated from point light sources to the photoconductor of the image forming apparatus, includes an incidence face through which the light generated from the point light sources are introduced, and a diffusion pattern provided at the incidence face and serving to diffuse the light introduced through the incidence face.

The diffusion pattern may include at least one recess.

The diffusion pattern may include a plurality of recesses, and the plurality of recesses may define a waveform in a longitudinal direction of the light guide member.

The diffusion pattern may include a plurality of recesses, and a radius of curvature of the plurality of recesses may increase toward opposite sides of a recess corresponding to each of the point light sources.

In accordance with even yet another aspect of the present disclosure, a developing device assembly includes a photoconductor, a photoconductor housing to rotatably support the photoconductor, a charger to charge the photoconductor with a predetermined electric potential, a light scanning unit to irradiate light, corresponding to image information, to the photoconductor charged with the predetermined electric potential, so as to form an electrostatic latent image, a developer feeder to feed developer to the photoconductor, on which the electrostatic latent image is formed, so as to form a visible image, and a charge eliminator to eliminate a residual electric potential remaining on a surface of the photoconductor, the charge eliminator including a light source array having a plurality of point light sources, a light guide member including an incidence face through which light generated from the point light sources is introduced, the light guide member serving to guide the light introduced through the incidence face to the photoconductor, and a diffusion pattern provided at the incidence face of the light guide member and serving to diffuse the light introduced through the incidence face.

The diffusion pattern may include at least one recess.

The charge eliminator may further include a fixing portion provided at the light guide member and serving to fix the light guide member to the photoconductor housing, and an interval between the point light sources of the light source array may become narrow closer to the fixing portion.

BRIEF DESCRIPTION OF THE DRAWINGS

Various features and advantages of the disclosure will become more apparent by the following detailed description of several embodiments thereof with reference to the attached drawings, of which.

DETAILED DESCRIPTION OF SEVERAL EMBODIMENTS

Figure 1:
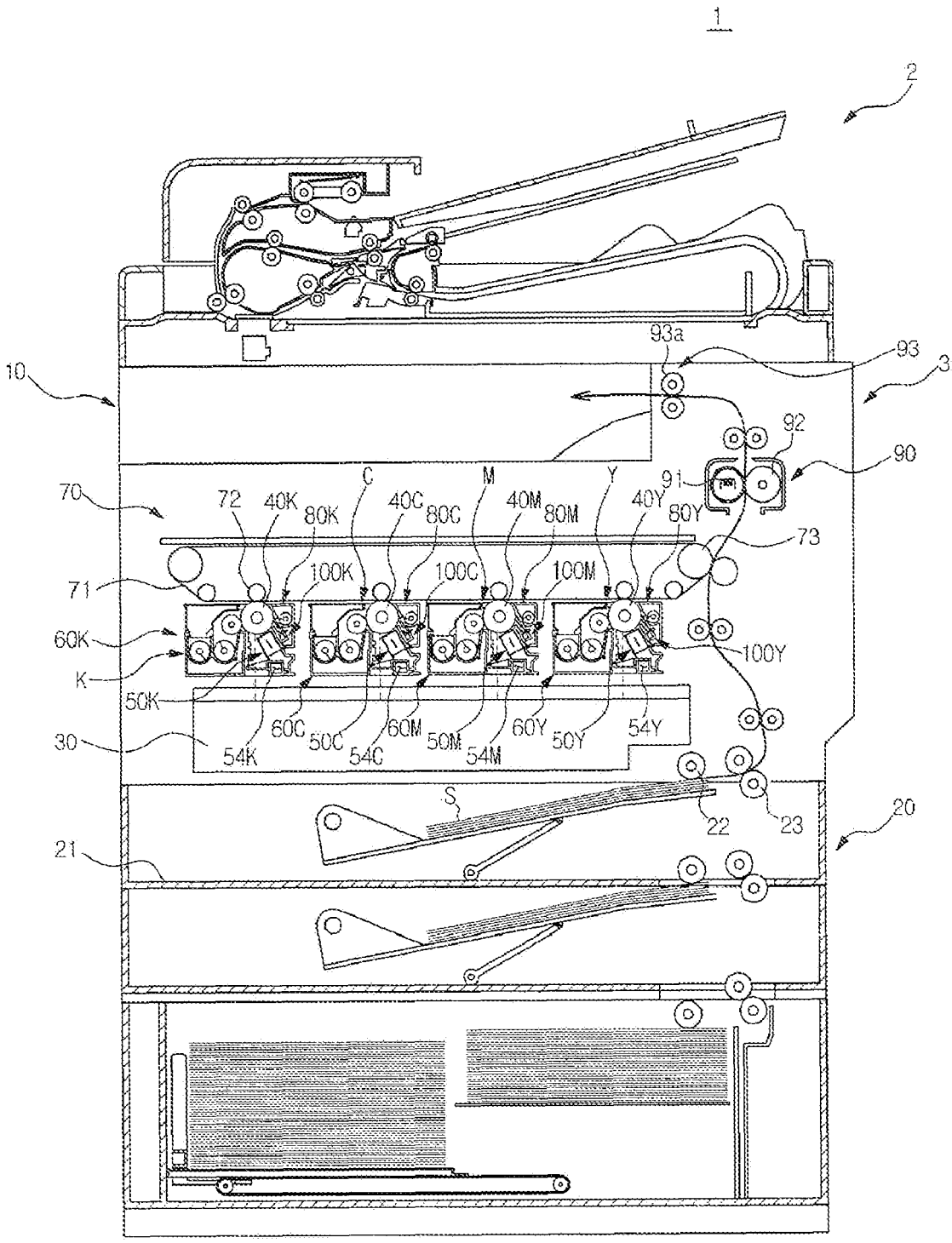
FIG. 1 is a sectional view for illustrating the configuration of an image forming apparatus according to one or more embodiments of the present disclosure.

Reference will now be made in detail to the embodiments of the present disclosure, examples of which are illustrated in the accompanying drawings, wherein like reference numerals refer to the like elements throughout.

FIG. 1 is a sectional view of an image forming apparatus according to an embodiment of the present disclosure, which may include, for example, without limitation, an image reading unit 2 configured to read an image from a document and a printing device 3 to print the image read from the document, or according to image signal received from other external sources, on a printing medium.

The printing device 3 may be configured to print an image based on signals received from the image reading unit 2, or from external appliances, such as, for example, a personal computer (PC), or the like. The printing device 3 may include: a body 10; a paper supply unit 20; a light scanning unit 30; photoconductors 40K, 40C, 40M and 40Y; chargers 50K, 50C, 50M and 50Y; developer feeders 60K, 60C, 60M and 60Y; a transfer unit 70; developer collectors 80K, 80C, 80M and 80Y; a fusing unit 90; a paper discharge unit 93; and charge eliminators 100K, 100C, 100M and 100Y.

The body 10 may define the external appearance of the printing device 3, and may support a variety of elements that may be installed therein.

The paper supply unit 20 may includes a cassette 21 in which a supply of printing media S may be stored, a pickup roller 22 configured to pick up the printing media S stored in the cassette 21 sheet by sheet and delivery rollers 23 to deliver the picked-up printing medium S toward the transfer unit 70.

The light scanning unit 30 may be configured to irradiate light that corresponds to image information on the photoconductors 40K, 40C, 40M and 40Y so as to form electrostatic latent images on respective surfaces of the photoconductors 40K, 40C, 40M and 40Y.

Prior to the irradiation by the light scanning unit 30, the surfaces of the photoconductors 40K, 40C, 40M and 40Y may have been pre-charged with a predetermined electrical potential by the chargers 50K, 50C, 50M and 50Y, and upon being irradiated with the light may exhibit thereon potential differences that constitute electrostatic latent images.

The chargers 50K, 50C, 50M and 50Y may be, for example, scorotron type chargers, which operates using corona discharges. The image forming apparatus according to an embodiment may include suction ducts 54K, 54C, 54M and 54Y for removal of ozone, such as nitrogen oxide (NOx), for example, which may be produced as byproducts of the corona discharge. It should be noted however that the scorotron charger is only one example of the various types of chargers, and that other types, for example, charging rollers know to those skilled in the art, may also be used in alternative embodiments.

The developer feeders 60K, 60C, 60M and 60Y may feed developer to the electrostatic latent images formed on respective one of the photoconductors 40K, 40C, 40M and 40Y so as to develop the latent images into visible images. According to an embodiment, the image forming apparatus may be configured to form color images, and according to such embodiment, the developer feeders 60K, 60C, 60M and 60Y may feed developer of respective one of different colors, for example, black, cyan, magenta and yellow.

The transfer unit 70 may include an intermediate transfer belt 71, first transfer rollers 72, and a second transfer roller 73. The first transfer rollers 72 may be configured to transfer the visible images formed on the photoconductors 40K, 40C, 40M and 40Y to the intermediate transfer belt 71. The image on the intermediate transfer belt 71 may be transferred to a printing medium supplied from the paper supply unit 20 when the printing medium passes between the second transfer roller 73 and the intermediate transfer belt 71.

The developer collectors 80K, 80C, 80M and 80Y may collect waste or residual developer remaining on the photoconductors 40K, 40C, 40M and 40Y after the transfer of the visible images to the intermediate transfer belt 71. While in the above description, an intermediate transfer belt is described as the intermediary between the photoconductors and the printing medium for the transfer of the visible images, it should be understood by those skilled in the art that other embodiments in which the printing medium may be routed so as to realize a direct transfer of the visible images from the photoconductors to the printing medium are also possible.

The fusing unit 90 may include a heating roller 91 and a press roller 92. When the printing medium, to which the image has been transferred, passes between the heating roller 91 and the press roller 92, the image is fixed to the printing medium by heat and pressure. The printing medium having passed through the fusing unit 90 is guided to the paper discharge unit 93 and is discharged out of the body 10 of the printing device 3 by paper discharge rollers 93*a*.

The charge eliminators 100Y, 100C, 100M and 100K are configured to remove the residual electrical potential remaining on the surfaces of the photoconductors 40K, 40C, 40M and 40Y, and will be described in greater detail later.

Figure 2:
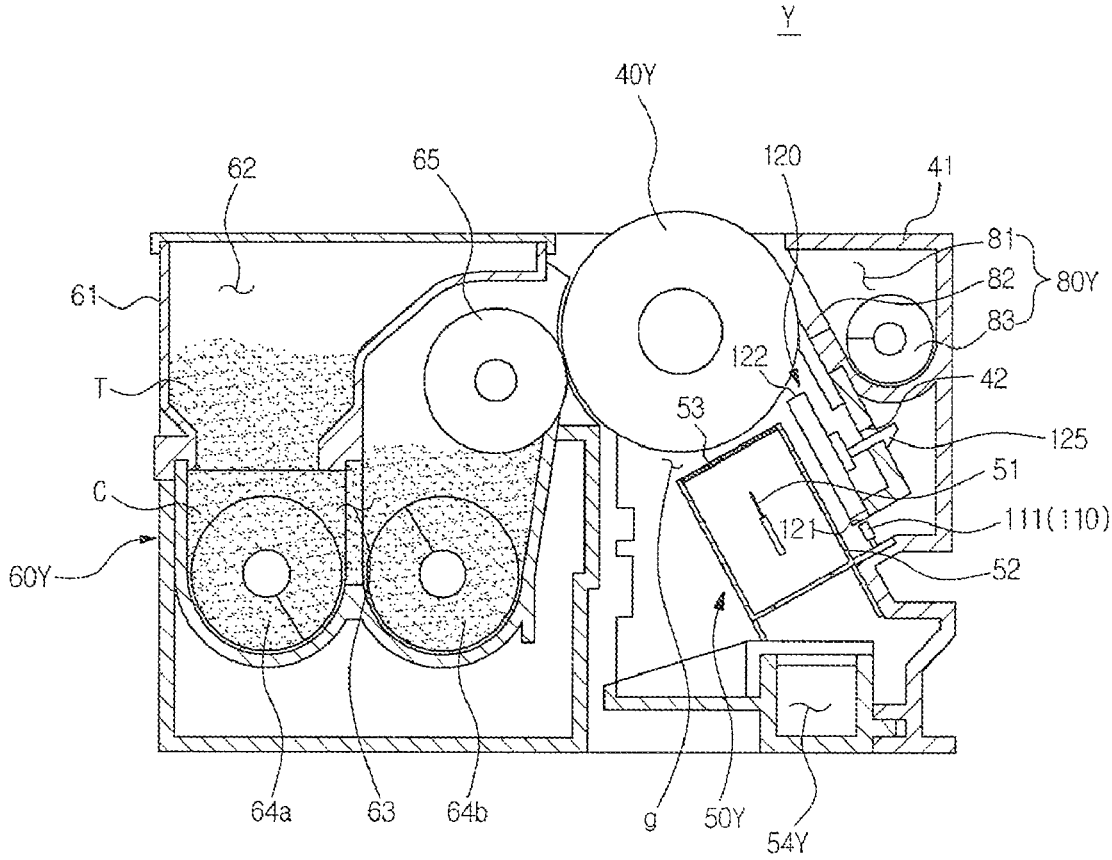
FIG. 2 is a sectional view illustrative of an internal configuration of a developing device assembly according to an embodiment.
Figure 3:
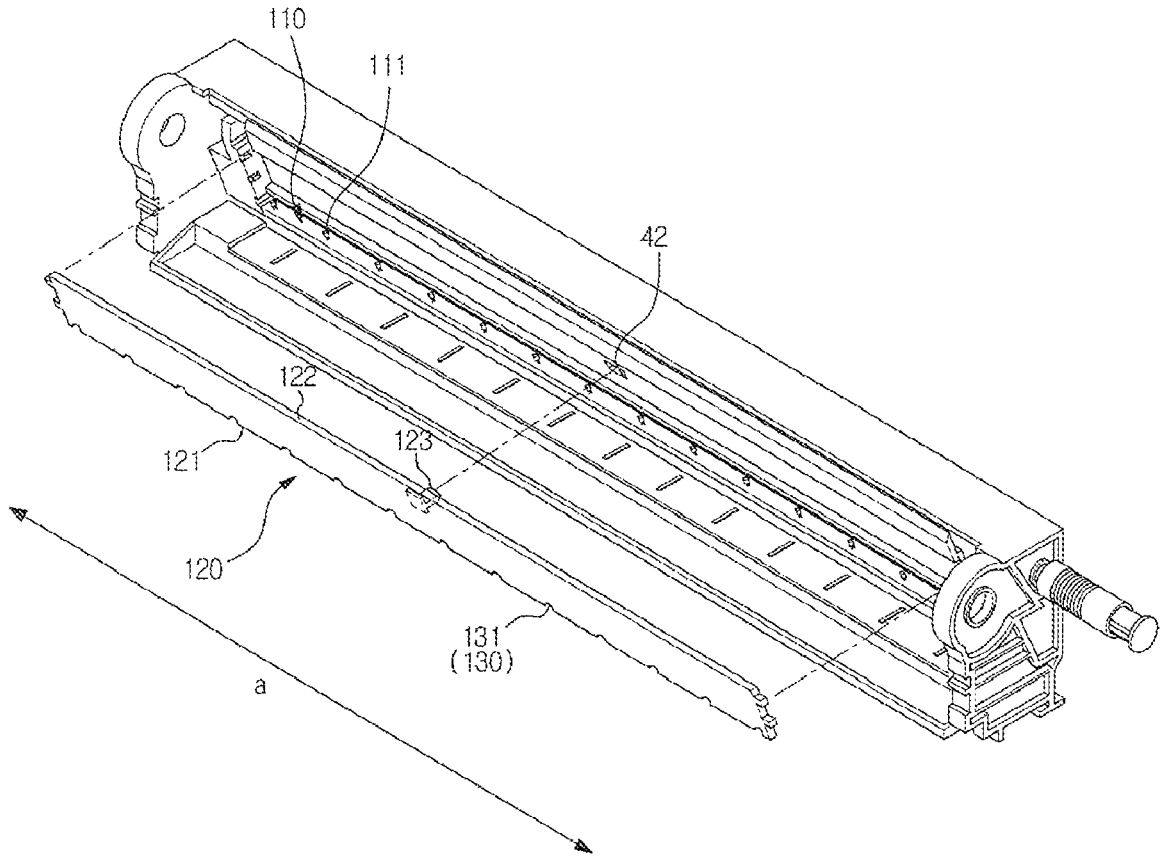
FIG. 3 is a perspective view illustrative of a photoconductor housing and a light guide member according to an embodiment.
Figure 4:
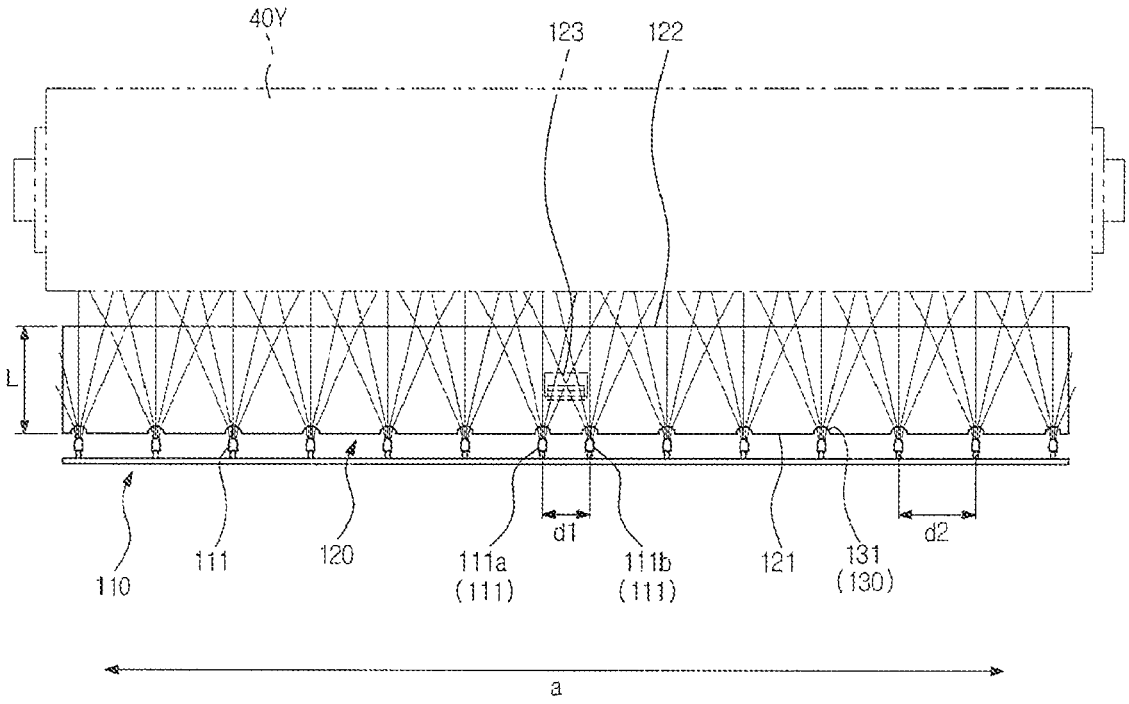
FIG. 4 is illustrative of a light source portion and the light guide member according to an embodiment.

FIG. 2 is a sectional view of the internal configuration of a developing device according to an embodiment. FIG. 3 is a perspective view of a photoconductor housing and a light guide member according to an embodiment. FIG. 4 illustrates a light source part and a light guide member according to an embodiment.

Referring to FIGS. 2-4, an image forming apparatus 1 according to an embodiment may include one or more developing device assemblies. For brevity, the developing device assembly Y for forming a yellow visible image using yellow developer will be described by way of example, it should be understood however that the image forming apparatus 1 may also include other developing device assemblies, for forming images of other colors, e.g., magenta, cyan and black (M, C and K) as depicted in FIG. 1, and that the below description of the developing device assembly Y would be applicable substantially equally to such other developing device assemblies.

The developing device assembly Y may include the photoconductor 40Y, developer feeder 60Y, waste developer collector 80Y, charger 50Y and charge eliminator 100Y (see also FIG. 1). The developing device assembly Y may be detachably coupled to the body 10 so that it may be separated from the body 10 for supplementing developer or for replacement of one or more elements thereof.

The photoconductor 40Y may be rotatably installed in a photoconductor housing 41. The photoconductor housing 41 may include a coupling portion 42 corresponding to a fixing portion 123 (see FIG. 3) of a light guide member 120 provided in the charge eliminator 100Y. According to an embodiment, the fixing portion 123 of the light guide member 120 may be, for example, a hook while the coupling portion 42 of the photoconductor housing 41 may be a recess of the shape allowing an engagement with the hook for securely supporting the fixing portion 123.

The charger 50Y charges the photoconductor 40Y having passed through the charge eliminator 100Y to a predetermined electrical potential. To that end, the charger 50Y, according to an embodiment, may include a discharge pin 51, a shield 52 provided to surround the discharge pin 51 and a screen 53 arranged at an open side of the shield 52 facing the photoconductor 40Y.

The developer feeder 60Y may include: a developer case 61, in which a developer receiving chamber 62 and an agitating chamber 63 may be defined; delivery members 64*a* and 64*b* received in the agitating chamber 63; and a developing device 65 for feeding the developer received in the agitating chamber 63 to the photoconductor 40Y.

The developer T received in the developer receiving chamber 62 is fed into the agitating chamber 63, so as to be agitated by the two delivery members 64*a* and 64*b*. During the agitating operation, the developer T may become electrically charged via friction with carrier C. The developing device 65 attaches, often by electrostatic force, the charged developer to the photoconductor 40Y on which the electrostatic latent image has been formed, thus forming a visible image.

The waste developer collector 80Y may include a cleaning blade 82 to scrape and collect waste developer remaining on the photoconductor 40Y, a collecting chamber 81 defined in the photoconductor housing 41 to store the collected waste developer and an agitating member 83 to agitate the waste developer stored in the collecting chamber 81.

The charge eliminator 100Y may include a light source array 110 and a light guide member 120.

The light source array 110 may include a plurality of point light sources 111, which may be arranged at a predetermined interval with respect to each other. A point light source according to an embodiment may be, for example, a light emitting diode (LED), and can however be any other types of light source.

The light guide member 120 may include an incidence face 121 opposingly facing the point light sources 111 of the light source array 110 and an emission face 122 facing the photoconductor 40Y.

The charge eliminator 100Y according to an embodiment may further include a diffusion pattern 130 having a plurality of recesses 131 defined on the incidence face 121 of the light guide member 120 corresponding to the point light sources 111. Light introduced through the incidence face 121 is refracted at the recesses 131, causing diffusion of flux of light introduced into the light guide member 120 (see FIG. 4). Accordingly, irradiating the charge eliminating light evenly across the length of the photoconductor may be possible with a smaller number of point light sources, thus enabling a reduction in the number of required point light sources used. The reduction in the number of the point light sources may advantageously enhanced productivity by allowing reductions in the cost and complexity in manufacturing of the charge eliminator and image forming apparatus having the same. It may also enable reduction in the required length L of the light guide member 120 (see FIG. 4), contributing to the reduction in the sizes of the charge eliminator and the image forming apparatus having the same.

The respective interval between the point light sources 111 of the light source array 110 according an embodiment may be variable, and may become narrower closer to the fixing portion 123 of the light guide member 120. In FIG. 4, the reference symbols d1 indicates the interval between two adjacent point light sources 111*a* and 111*b* close to the fixing portion 123 of the light guide member 120 while the reference symbol d2 represents the intervals between the neighboring point light sources other than the distance between the two point light sources 111*a* and 111*b*. According to an embodiment, the intervals between the point light sources may gradually decrease from both ends of the light guide member 120 toward the fixing portion 123. Accordingly, in the charge eliminator 100Y according to an embodiment, the interval between the point light sources 111 close to the fixing portion 123 of the light guide member 120 may be made relatively narrower to thereby compensate for the loss of light due to the fixing portion 123, and consequently even greater uniformity in the charge elimination across the photoconductor 40Y surface may be realized.

Figure 5:
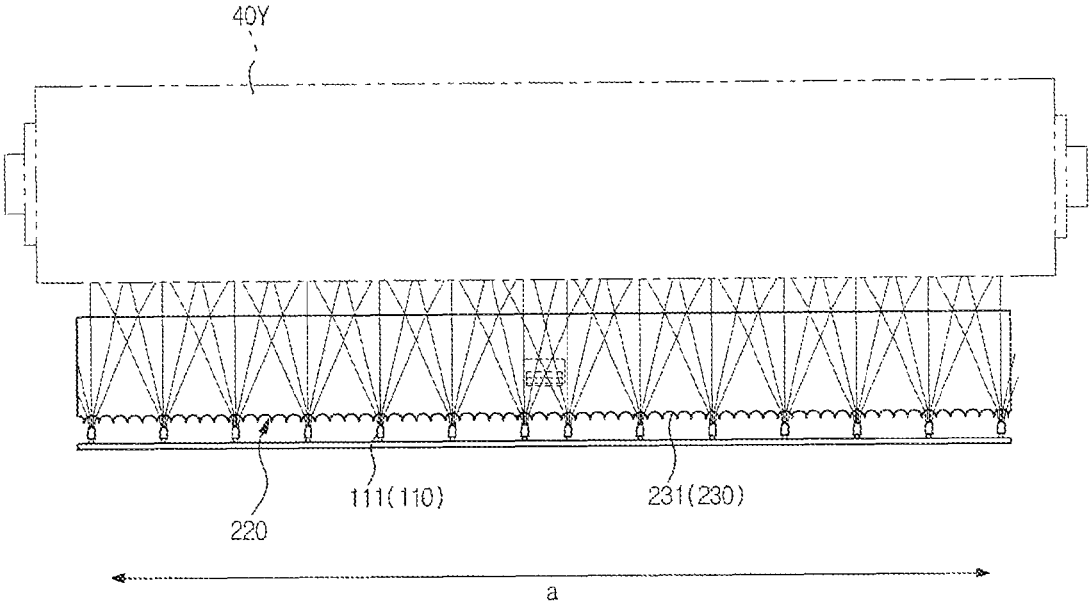
FIG. 5 is illustrative of a light source portion and a light guide member according to another embodiment.
Figure 6:
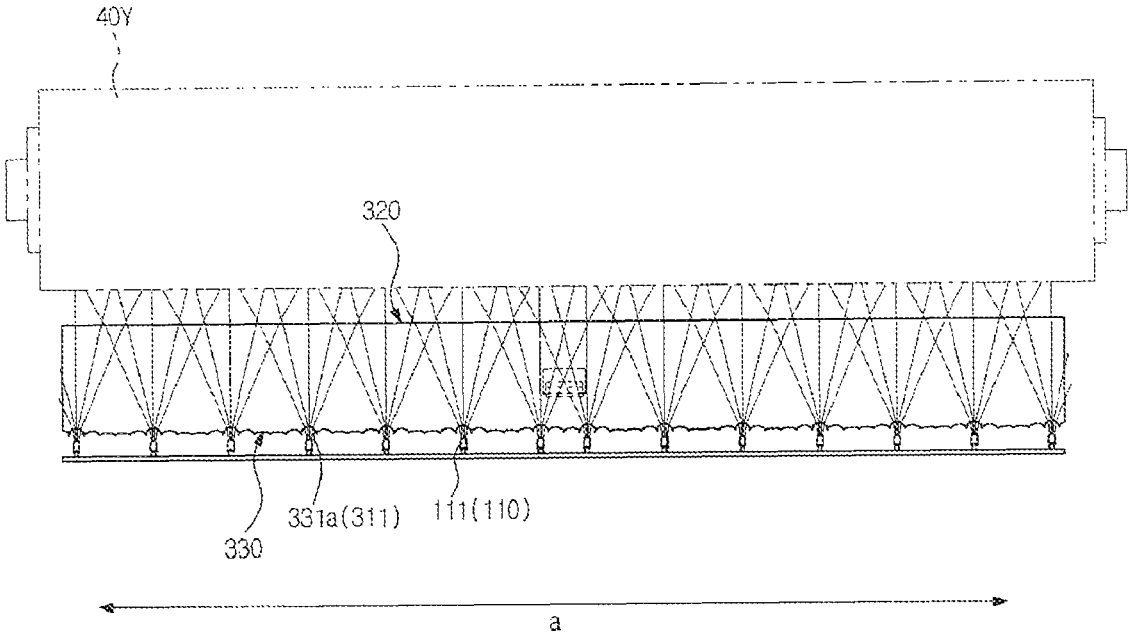
FIG. 6 is illustrative of a light source portion and a light guide member according to yet another embodiment.

FIGS. 5 and 6 are illustrative of a light source part and a light guide member according to other embodiments. For the sake of brevity, those elements substantially the same as those previously described will be designated by the same reference numerals without repeating the descriptions thereof.

A diffusion pattern 230 of a light guide member 220 according to an embodiment illustrated in FIG. 5 may include a plurality of recesses 231 defining a waveform extending along the longitudinal direction a of the light guide member 220. According to yet another embodiment, the diffusion pattern 330 of the light guide member 320 shown in FIG. 6 may include a plurality of recesses 331, the radius of curvature or concavity of which may be arranged to increases closer toward the each recess 331*a* respectively corresponding to each point light source 111.

It should be apparent to those skilled in the art that various other modifications can be made to those embodiments described above by way of examples while still realizing the advantages and features of one or more aspects of the present disclosure.

For example, although in the description above the developer feeder that uses two component developer has been described by way of an example, single component developer may alternatively be used. Also, while a developing device assembly is described to include those components, such as, the photoconductor, developer feeder, waste developer collector, charger and charge eliminator as integral part of the assembly, one or more of these components can be provided in the image forming apparatus body as separate units.

It should also be noted that the number, the positions and/or the shapes of the recesses are not limited to those of the embodiments herein described.

Further, although the fixing portion 123 and the coupling portion 42 for the light guide member 120 are described above as being of a hook and a correspondingly shaped recess, respectively, it should be readily understood that many other shapes and/or configurations are also possible.

According to an aspect of the present disclosure, a charge eliminator and image forming apparatus having the same may be capable of irradiating charge eliminating light evenly across the photoconductor.

According to an aspect of the present disclosure, it may be possible to realize a lower cost and enhanced productivity in the manufacture of a charge eliminator and an image forming apparatus.

While the disclosure has been particularly shown and described with reference to several embodiments thereof with particular details, it will be apparent to one of ordinary skill in the art that various changes may be made to these embodiments without departing from the principles and spirit of the invention, the scope of which is defined in the following claims and their equivalents.

What is claimed is:

1. A charge eliminator to eliminate a residual electrical potential from a surface of a photoconductor, comprising: a light source array including a plurality of point light sources; a light guide member including an incidence face through which light generated from the point light sources is introduced, the light guide member being configured to guide the light introduced through the incidence face to the photoconductor; and a diffusion pattern provided at the incidence face of the light guide member, the diffusion pattern being configured to diffuse the light introduced through the incidence face.

2. The charge eliminator according to claim 1, wherein the diffusion pattern includes at least one recess.

3. The charge eliminator according to claim 2, wherein the diffusion pattern includes a plurality of recesses that defines a waveform extending along a longitudinal direction of the light guide member.

4. The charge eliminator according to claim 3, wherein ones of the plurality of recesses that respectively correspond to each of the plurality of point light sources each have a radius of curvature smaller than that of adjacent ones of the plurality of recesses.

5. The charge eliminator according to claim 1, wherein the light guide member comprises a fixing portion for positioning the light guide member, and wherein a first interval between at least two point light sources near the fixing portion being smaller than a second interval between a pair of point light source further away from the fixing portion.

6. The charge eliminator according to claim 5, wherein the fixing portion comprises a hook protruding from the light guide member.

7. The charge eliminator according to claim 1, wherein the point light sources each comprise a light emitting diode (LED).

8. An image forming apparatus, comprising: a photoconductor; a charger configured to charge the photoconductor to a predetermined electrical potential; a light scanning unit configured to irradiate light that correspond to image information to the photoconductor charged with the predetermined electrical potential to thereby form an electrostatic latent image; a developer feeder configured to feed developer to thereby develop the electrostatic latent image of the photoconductor into a visible image; a transfer unit to configured transfer the visible image formed on the photoconductor to a printing medium; and a charge eliminator configured to eliminate a residual electric potential remaining on a surface of the photoconductor, the charge eliminator comprising: a light source array including a plurality of point light sources; a light guide member including an incidence face through which light generated from the point light sources is introduced, the light guide member being configured to guide the light introduced through the incidence face to the photoconductor; and a diffusion pattern provided at the incidence face of the light guide member, the diffusion pattern being configured to diffuse the light introduced through the incidence face.

9. The image forming apparatus according to claim 8, wherein the diffusion pattern includes at least one recess.

10. The image forming apparatus according to claim 9, wherein the diffusion pattern includes a plurality of recesses that defines a waveform extending along a longitudinal direction of the light guide member.

11. The image forming apparatus according to claim 10, wherein ones of the plurality of recesses that respectively correspond to each of the plurality of point light sources each have a radius of curvature smaller than that of adjacent ones of the plurality of recesses.

12. The image forming apparatus according to claim 8, further comprising a photoconductor housing to rotatably support the photoconductor, wherein the charge eliminator comprises a fixing portion provided on the light guide member for fixedly supporting the light guide member to the photoconductor housing, and wherein an interval between the point light sources of the light source array becomes narrower closer to the fixing portion.

13. The image forming apparatus according to claim 12, wherein the fixing portion comprises a hook protruding from the light guide member.

14. A light guide member for guiding light received from one or more point light sources of a charge eliminator toward a photoconductor to eliminate a residual electrical potential from the photoconductor of an image forming apparatus, comprising: an incidence face through which the light generated from the point light sources is introduced; and a diffusion pattern provided at the incidence face of the light guide member, the diffusion pattern being configured to diffuse the light introduced through the incidence face.

15. The light guide member according to claim 14, wherein the diffusion pattern includes at least one recess.

16. The light guide member according to claim 15, wherein the diffusion pattern includes a plurality of recesses that defines a waveform extending along a longitudinal direction of the light guide member.

17. The member according to claim 16, wherein ones of the plurality of recesses that respectively correspond to each of the one or more point light sources each have a radius of curvature smaller than that of adjacent ones of the plurality of recesses.

18. A developing device assembly, comprising: a photoconductor; a photoconductor housing to rotatably support the photoconductor; a charger to charge the photoconductor to a predetermined electric potential; a light scanning unit configured to irradiate light that correspond to image information to the photoconductor charged with the predetermined electrical potential to thereby form an electrostatic latent image; a developer feeder configured to feed developer to thereby develop the electrostatic latent image of the photoconductor into a visible image; and a charge eliminator configured to eliminate a residual electric potential remaining on a surface of the photoconductor, the charge eliminator comprising: a light source array including a plurality of point light sources; a light guide member including an incidence face through which light generated from the point light sources is introduced, the light guide member being configured to guide the light introduced through the incidence face to the photoconductor; and a diffusion pattern provided at the incidence face of the light guide member, the diffusion pattern being configured to diffuse the light introduced through the incidence face.

19. The developing device assembly according to claim 18, wherein the diffusion pattern includes at least one recess.

20. The developing device assembly according to claim 18, wherein: wherein the charge eliminator comprises a fixing portion provided on the light guide member for fixedly supporting the light guide member to the photoconductor housing, and wherein an interval between the point light sources of the light source array becomes narrower closer to the fixing portion.

* * * * *